US005535660A

United States Patent [19]

Zierler

[11] Patent Number: 5,535,660

[45] Date of Patent: Jul. 16, 1996

[54] BREECH CLOSURE FOR A BARREL-TYPE FIREARM

[75] Inventor: Reinhard Zierler, Micheldorf, Austria

[73] Assignee: Intertechnik Techn. Produktionen Gesellschaft m.b.H., Linz, Austria

[21] Appl. No.: 409,131

[22] Filed: Mar. 23, 1995

[30] Foreign Application Priority Data

Mar. 25, 1994 [AT] Austria ..... 642/94

[51] Int. Cl.[6] ..... F41A 3/76

[52] U.S. Cl. ..... 89/26; 89/24; 89/27.13

[58] Field of Search ..... 89/26, 21, 27.13, 89/24; 42/19

[56] References Cited

U.S. PATENT DOCUMENTS 3,354,780 11/1967 Ramsay ..... 89/26
3,707,900 1/1973 Hornfeck et al. ..... 89/26
4,195,550 4/1980 Witt et al. ..... 89/27.13
5,054,365 10/1991 Wissing ..... 89/26

FOREIGN PATENT DOCUMENTS 9217746 10/1992 WIPO ..... 89/26

*Primary Examiner*—Stephen M. Johnson
*Attorney, Agent, or Firm*—Collard & Roe

[57] ABSTRACT

A breech closure for a barrel-type firearm is described, in which a flow passage for an igniting jet from an igniting cartridge held in a magazine extends through a breechblock. The breechblock is formed on that side which faces the magazine with a cylindrical recess, which is coaxial to the flow passage for the igniting jet and contains a metal sealing cup, the side wall of which contacts the peripheral surface of the recess and which has a bottom, which is formed with a central through opening for receiving the igniting jet and constitutes a conical disk spring, which bears on the contacting surface of the magazine around said through opening, the rim of which is enlarged to form a bead on the inside of the cup.

7 Claims, 3 Drawing Sheets

BREECH CLOSURE FOR A BARREL-TYPE FIREARM

BACKGROUND OF THE INVENTION

1. Field of the Invention

This invention relates to a breech closure for a barrel-type firearm, in which a flow passage for conducting an igniting jet from an igniting cartridge held in a magezine extends through a breechblock.

2. Description of the Prior Art

To permit a gun to be fired after it has been loaded, an igniting cartridge must be inserted into the breech closure and a propellant charge for the projectile which has been loaded must be fired by an igniting jet, which is generated by the igniting cartridge and passes in a flow passage through the breechblock. Such igniting cartridges are usually inserted into the breech closure by hand because if a magazine is provided which is suitable for that purpose and in which the igniting cartridges are held it will be rather difficult to gastightly connect the magazine holding the igniting cartridges to the flow passage of the breechblock. In that case it must be taken into account that a gastightness in a very wide pressure range, e.g., between 100 and 4000 bars, must be ensured and that measures which may be adopted to seal against high pressures may sometimes be inconsistent with measures which will be required to seal against low pressures.

SUMMARY OF THE INVENTION

For this reason it is an object of the invention to provide for barrel-type firearms a breech closure which is of the kind described first hereinbefore and is so designed that a gastightness meeting all requirements will be ensured between the breechblock and the magazine in which the igniting cartridges are held.

The object set forth is accomplished in accordance with the invention in that the breechblock is formed on that side which faces the magazine with a cylindrical recess, which is coaxial to the flow passage for the igniting jet and contains a metal sealing cup, the side wall of which contacts the peripheral surface of the recess and which has a bottom, which is formed with a central through opening for receiving the igniting jet and constitutes a conical disk spring, which bears on the contacting surface of the magazine around said through opening, the rim of which is enlarged to form a bead on the inside of the cup.

The outer rim of the central through opening for receiving the igniting jet generated by the igniting cartridge which is held in the magazine and has been moved to an igniting position constitutes a sealing rim, which owing to the relatively small sealing surface will have a desirable effect in sealing against relatively low gas pressures. The high gas pressure which after the ignition of the propellant charge builds up between the projectile and the breechblock acts through the flow passage on the inside surface of the sealing cup and as the pressure increases the side wall of the sealing cup is forced against the peripheral surface of the recess which contains the sealing cup and the conical disk spring, which is constituted by the bottom of the cup is stressed. As a result, portions of that bottom, which progressively increase radially from the initial contacting rim, are moved into surface contact with the adjacent surface of the magazine until a snug engagement of the entire bottom of the cup with the magazine has been achieved so that large sealing surfaces are provided at the side wall and at the bottom of the cup and are desirably effective for sealing against high gas pressures.

The bead provided on the inside of the cup around the through opening for receiving the igniting jet establishes desirable conditions for the contact with the bottom of the cup under a relatively low pressure. Besides, that annular bead on the inside of the cup defines around the flow passage an annular-space, in which the injector action of the igniting jet generated by the igniting cartridge and flowing through the breechblock generates a negative pressure, which during the backflow of the gases produced by the propellant charge assists a rapid buildup of pressure in the interior of the cup so that the bottom of the cup will reliably move into gastight contact with the magazine initially adjacent to that rim of the through opening for receiving the igniting jet, which rim is reinforced by the bead. The higher pressure will subsequently result in a contact of the bottom of the cup in a larger area, as is then required.

In addition, the negative pressure which is built up in the interior of the cup under the injector action of the igniting jet from the igniting cartridge can be increased in that the bottom of the recess containing the sealing cup is formed with an annular bead, which surrounds the flow passage and which defines the annular space around the flow passage so that the flow passage communicates with that annular space only through the annular opening which is left free between the enlarged rim of the through opening in the bottom of the cup and said annular bead.

It has already been pointed out that under high gas pressures the bottom of the cup must move into surface contact with the magazine in order to effect a sealing on comparatively large surfaces. To permit in that connection a particularly desirable matching of the bottom of the cup with the flat contacting surface of the magazine containing the igniting cartridges, the bottom of the sealing cup may constitute on its outside surface a conical annular surface, which under a sufficiently high load on the conical disk spring which is constituted by the bottom will move into snug contact with the adjacent magazine surface.

To ensure a gastight seal even when the sealing means are not under pressure, it is recommendable to insert the sealing cup between the bottom of the receiving recess and the contacting magazine in such a manner that the conical disk spring which is constituted by the bottom of the cup is under initial stress. The initial stress of the conical disk spring causes the bottom of the sealing cup to contact the adjacent magazine surface under a certain minimum pressure and thus ensures a reasonable seal between the sealing cup and the magazine.

Owing to the high loads and to the resiliently flexible behavior which is required, the sealing cup can be made of a metallic material, preferably of steel. But such a material will involve a risk that under the high pressures which are exerted the bottom of the cup may be bonded to the magazine by cold welding. In order to preclude that risk of cold welding, the sealing cup may be made of a material which resists cold welding or the sealing cup may be provided at least on the outside of its bottom with a coating which resists cold welding, e.g., an oxide layer.

DETAILED DESCRIPTION OF THE PREFERRED EMBODIMENT

Figure 1:
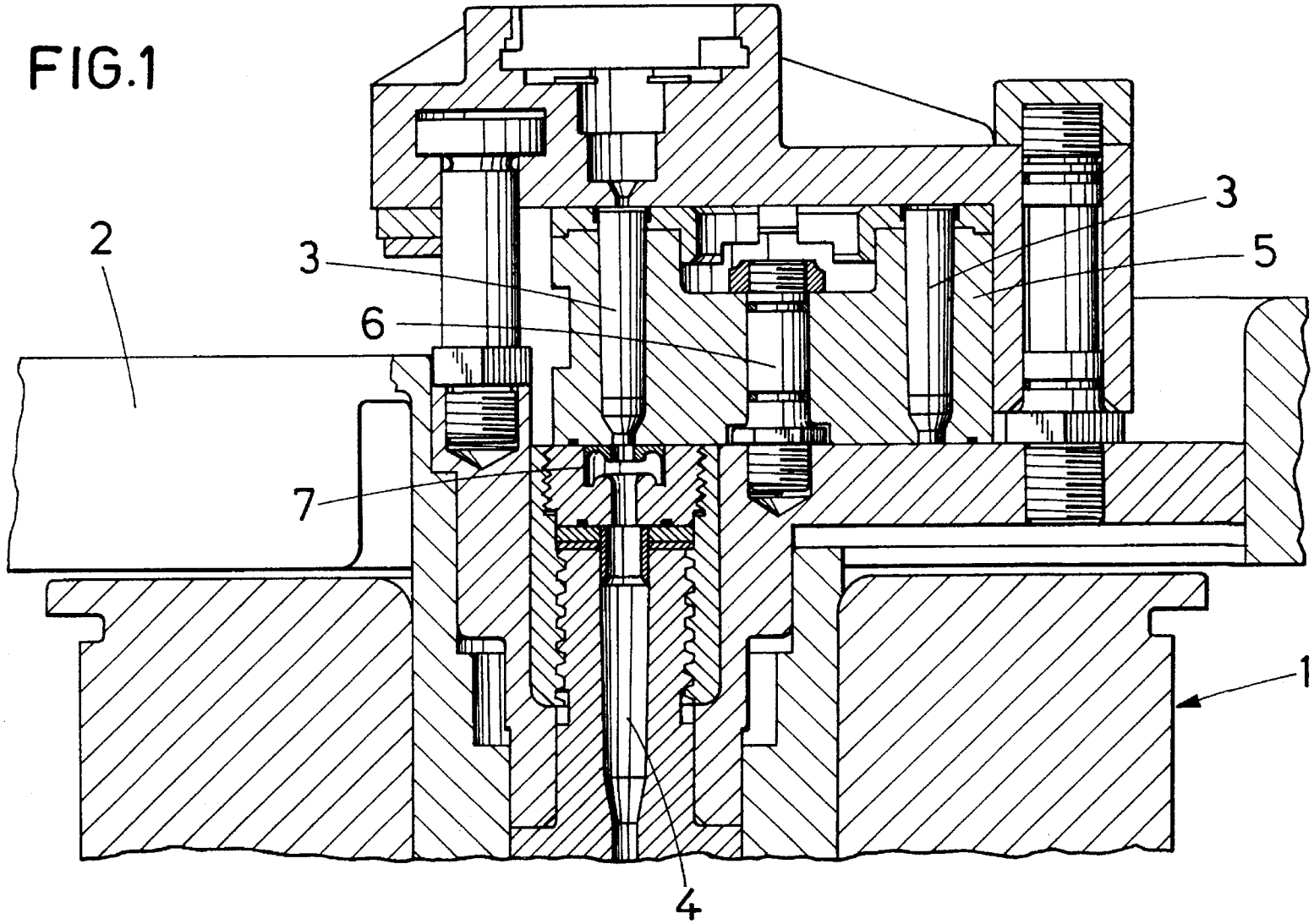
FIG. 1 is a simplified fragmentary axial sectional view showing a breech closure in accordance with the invention for a barrel-type firearm.

An illustrative embodiment of the invention will now be described more in detail with reference to the drawing.

As shown in FIG. 1 the illustrated breech closure consists of a breechblock 1, which is mounted on a carrier 2 and together with the carrier 2 is pivotally movable between open and closed positions about an axis which is at right angles to the axis of the barrel of the gun. In the open position the gun can be loaded. In the closed position the breechblock 1 seals the barrel of the gun at its rear so that the gun can be fired. The propellant charge with which the gun has been loaded together with the projectile can be ignited by an igniting cartridge 3, from which an igniting jet flows through a flow passage 4 in the breechblock 1 to the propellant charge and ignites the latter. A difference from conventional breech closures resides in that the igniting cartridge 3 is held in a magazine 5, which in the illustrated embodiment consists of a drum magazine and is rotated about the drum axis 6 by one igniting cartridge 3 whenever the breechblock 1 is closed so that the gun is ready to be fired when the breechblock 1 has been closed. But an automatic change of igniting cartridges by means of a magazine 5 which holds one of said igniting cartridges 3 in a stand-by position for igniting will not be possible unless the flow passage 4 in the breechblock 1 can be gastightly connected to the igniting cartridge 3 which is in a stand-by position for igniting.

Figure 2:
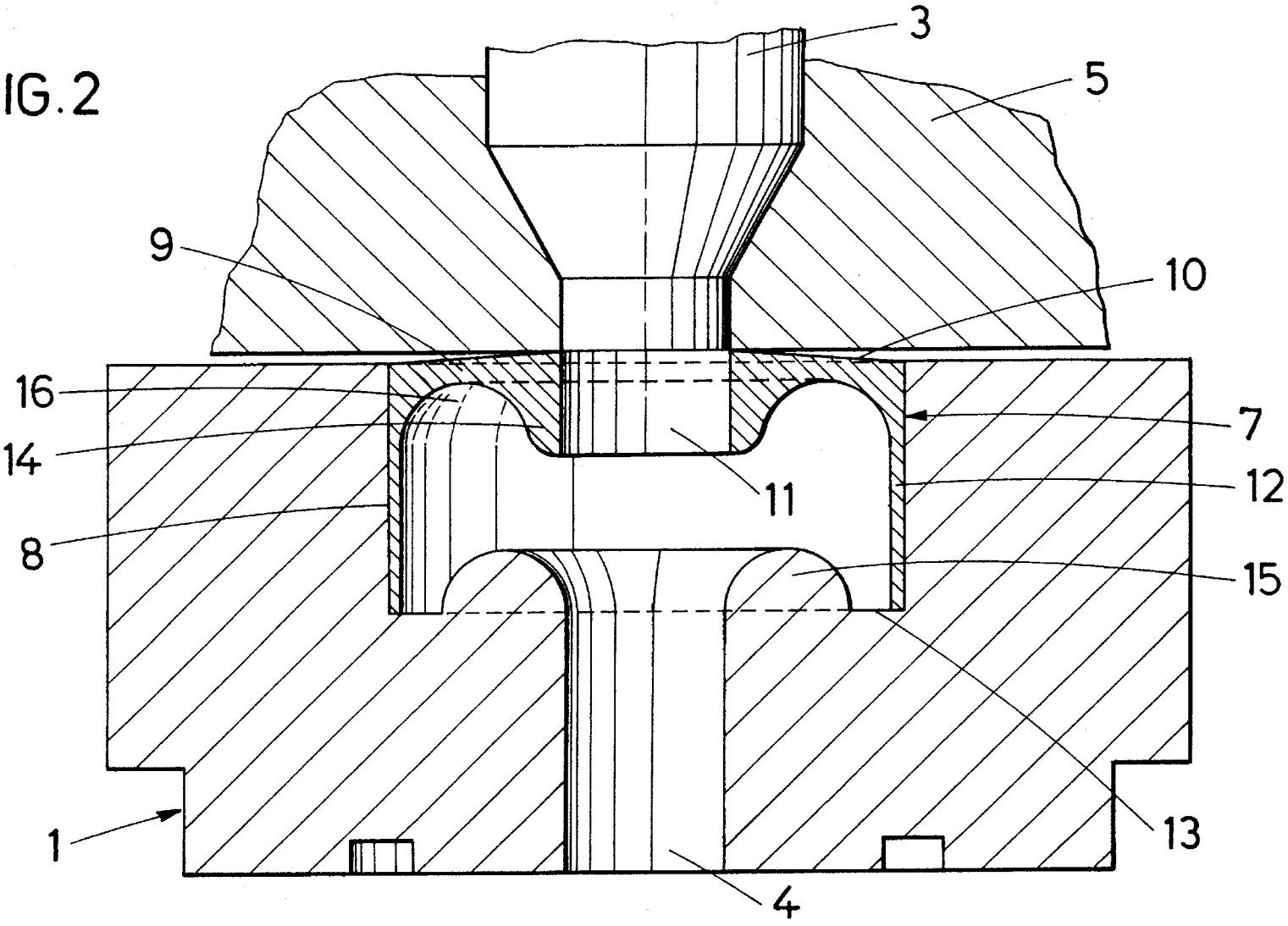
FIG. 2 is an enlarged sectional view showing the sealing means provided between the breechblock and a magazine for the igniting cartridges when said sealing means are under no pressure.
Figure 3:
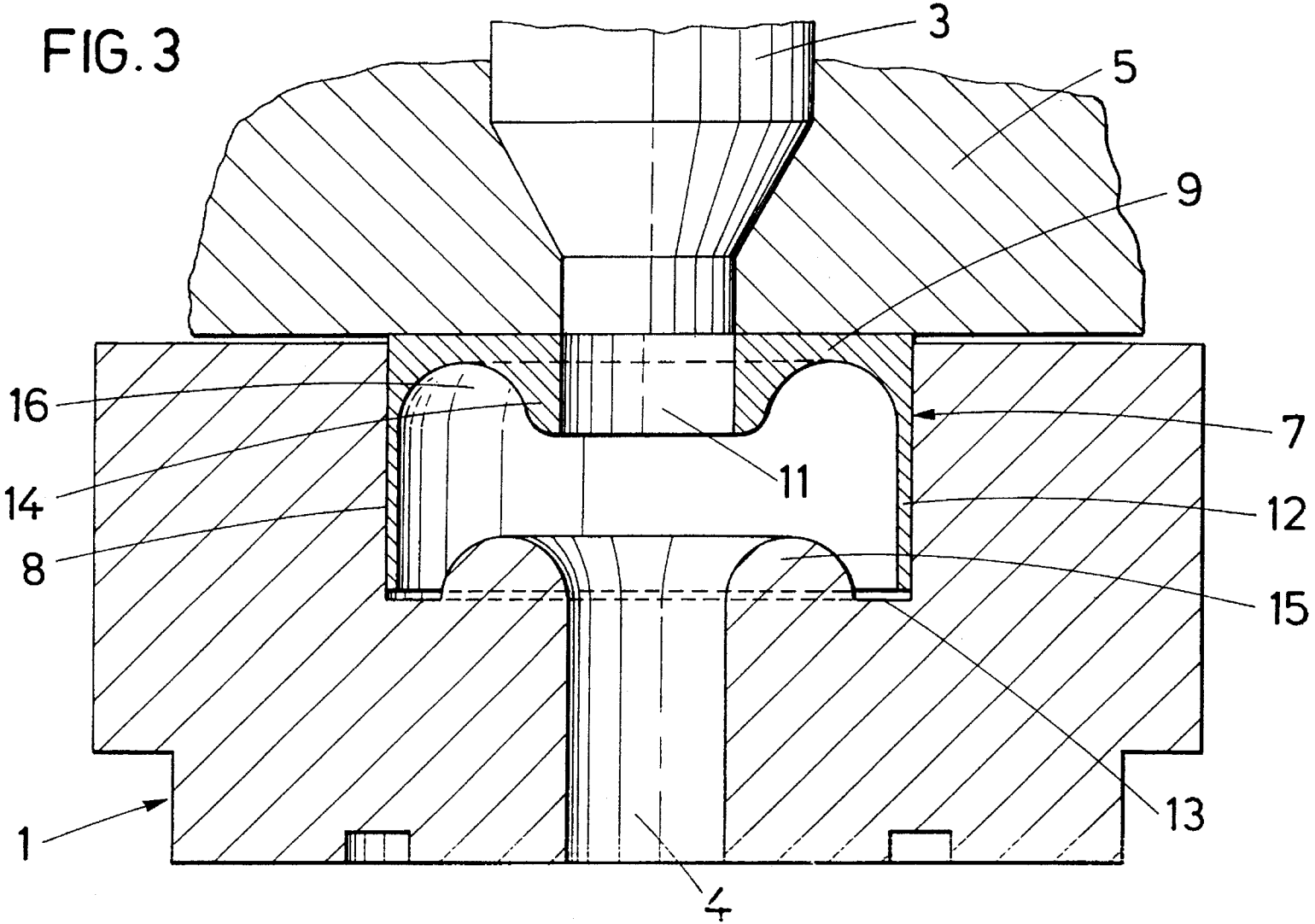
FIG. 3 is a view that is similar to FIG. 2 and shows the sealing means under the full pressure loading.

To ensure a gastightness throughout the pressure range to be expected, a metal sealing cup 7 is provided, which is fitted in a cylindrical recess 8, which is formed in the rear surface of the breechblock 1 and is coaxial to the flow passage 4. The cup 7 has a bottom 9 contacting the adjacent magazine surface. As is particularly apparent from FIG. 2 the bottom 9 of the sealing cup 7 has on the outside a conical annular surface 10, which is tapered from the through opening 11 for receiving the igniting jet toward the side wall 12 of the cup. Owing to that taper and the elastic properties of the material the bottom 9 of the sealing cup 7 constitutes a conical disk spring having spring properties which can desirably be utilized for the sealing action of the sealing cup 7. Under the initial stress of the conical disk spring constituted by the bottom 9 the sealing cup 7 is axially gripped between the bottom 13 of the receiving recess 8 and the magazine 5 and the bottom 9 of the sealing cup 7 is forced adjacent to the rim of the through opening 11 into sealing contact with the magazine 5. When the igniting cartridge 3 held in a stand-by position in the magazine 5 is ignited, the igniting jet will flow through the through opening 11 in the bottom 9 of the sealing cup 7 into the flow passage 4. Because the rim of the through opening 11 constitutes on the inside of the cup a bead 14, which together with an annular bead 15 formed on the bottom 13 of the recess around the flow passage 4 defines within the sealing cup 7 an open annular space 16, around the flow passage 4, the igniting jet owing to its injector action will generate in said annular space 16 a negative pressure, which when the propellant charge has been ignited and the gases from the propellant charge flow back through the flow passage 4 will assist a rapid buildup of pressure inside the sealing cup 7. The resulting pressure exerted by the side wall 12 of the cup on the peripheral surface of the recess and will deflect the conical disk spring which is constituted by the bottom 9 of the cup with the result that the bottom 9 of the cup will contact the magazine 5 on an area which increases from the through opening 11 until the entire bottom 9 of the cup is in snug contact with the magazine 5 to sea against the highest pressures, as is apparent from FIG. 3. For this reason the optimum sealing conditions will be established for lower pressures as well as for extremely high pressures. It is merely required to properly select the spring force of the conical disk spring and to ensure that said spring will be deflected. Favorable conditions will be established in most cases if the conical annular surface 10 has an included angle of, e.g., 176 to 178 degrees.

We claim:

1. A breech closure for a barrel-type firearm, which breech closure is adapted to be used together with a magazine for holding an igniting cartridge in a stand-by position for igniting a propellant charge in the firearm by an igniting jet, which breech closure comprises (a) a breechblock movable to a closed position and defining a flow passage for conducting said igniting jet from said igniting cartridge to said propellant charge when said breechblock is in said closed position, (1) the breechblock having a rear surface adapted to face an adjacent surface of said magazine and (2) said rear surface defining a cylindrical recess, which is coaxial with said flow passage and has a peripheral surface, and (b) a metal sealing cup fitted in said recess and having (1) a side wall contacting said peripheral surface of said recess and (2) a bottom constituted by a flat disk spring adapted to face the adjacent magazine surface, the bottom having a circular rim inwardly spaced from the side wall and defining a through opening arranged to receive said igniting jet, and the rim being enlarged in a direction facing away from the adjacent magazine surface to form a bead around the through opening.

2. The breech closure set forth in claim 1, wherein said recess has a bottom which is formed around said flow passage with an annular bead.

3. The breech closure set forth in claim 1, wherein said bottom of said sealing cup has on the outside a conical annular surface.

4. The breech closure set forth in claim 1, wherein said sealing cup is adapted to be fitted between a bottom of said recess and said magazine in such a manner that said disk spring is under an initial stress.

5. The breech closure set forth in claim 1, wherein said sealing cup is made of a material which resists cold welding.

6. The breech closure set forth in claim 1, wherein said bottom of sealing cup is provided at least on the outside of said bottom of said cup with a coating which resists cold welding.

7. The breech closure set forth in claim 6, wherein said coating consists of an oxide layer.

* * * * *